US006819773B2

(12) United States Patent
D'Hoogh

(10) Patent No.: US 6,819,773 B2
(45) Date of Patent: Nov. 16, 2004

(54) LOUDSPEAKER WITH A THREE-DIMENSIONAL DIAPHRAGM

(75) Inventor: Guido Odilon Maurits D'Hoogh, Dendermonde (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 163 days.

(21) Appl. No.: 10/213,403

(22) Filed: Aug. 6, 2002

(65) Prior Publication Data

US 2003/0031337 A1 Feb. 13, 2003

(30) Foreign Application Priority Data

Aug. 10, 2001 (EP) ..... 01203057.3

(51) Int. Cl.[7] ..... H04R 25/00

(52) U.S. Cl. ..... 381/396; 381/398; 381/423; 381/433

(58) Field of Search ..... 381/395, 396, 381/397, 398, 404, 407, 411, 423, 424, 429, 430, 432, 433

(56) References Cited

U.S. PATENT DOCUMENTS 5,898,786 A 4/1999 Geisenberger ..... 381/416
6,095,280 A * 8/2000 Proni ..... 181/171
6,385,327 B1 5/2002 D'Hough ..... 381/398
6,526,151 B1 * 2/2003 Peng ..... 381/403

FOREIGN PATENT DOCUMENTS

GB 2325373 11/1998 ..... H04R/9/02
WO WO9966763 12/1999 ..... H04R/7/20

* cited by examiner

*Primary Examiner*—Suhan Ni
(74) *Attorney, Agent, or Firm*—Edward W. Goodman

(57) ABSTRACT

An electro-dynamic loudspeaker includes a chassis (2), a three-dimensional diaphragm (8) and an electromagnetic actuator (6). The diaphragm is connected to the chassis by a first flexible connection (18) provided near a front part (8*a*) of the diaphragm and by a second flexible connection (20) provided near a back part (8*b*) of the diaphragm. The actuator includes a stationary actuator element (6*a*) fixed to the chassis and a translatable actuator element (6*b*) fixed to the diaphragm. When energized, both actuator elements magnetically co-operate with one another over an air gap (16). In order to realize a flat but powerful speaker, the device as such and the air gap are outside the area (26) enclosed by the diaphragm but within the space (24) between the first and second flexible connections.

8 Claims, 4 Drawing Sheets

LOUDSPEAKER WITH A THREE-DIMENSIONAL DIAPHRAGM

BACKGROUND OF THE INVENTION

1. Field of the Invention

The invention relates to an electro-dynamic loudspeaker comprising a chassis, a translatable body with a three-dimensional diaphragm extending within the chassis, the diaphragm comprising a front part and a back part, and an electromagnetic actuator for displacing said body with respect to the chassis along a translation axis extending from said front part to said back part of the diaphragm, said actuator comprising a stationary actuator element fixed to the chassis and a translatable actuator element connected to the translatable body proximate to the back part of the diaphragm, said actuator elements being capable of magnetically co-operating with each other over an air gap, while a first flexible connecting means is present proximate to the front part of the diaphragm for movably journaling the translatable body with respect to the chassis, and a second flexible connecting means is present proximate to the back part of the diaphragm for movably journaling the translatable body with respect to the chassis.

2. Description of the Related Art

A dynamic loudspeaker comprising a conical diaphragm, a loudspeaker housing with a loudspeaker basket and an electromagnetic driver is known from German Gebrauchsmuster DE-U 75 02 568. The driver is accommodated in the housing, outside the diaphragm, and has a driving coil arranged on a coil former secured to the diaphragm, as well as a magnetic system secured to the loudspeaker basket. The diaphragm, which is within the loudspeaker basket, is fixed on its front side to the loudspeaker basket via a flexible suspension rim, and on its rear side via a centering means. In the known loudspeaker, the driver is situated in an area outside the loudspeaker basket so that the loudspeaker has a relatively large axial dimension. This has the drawback that the depth of the housing in practical embodiments is relatively large with respect to the front dimensions of the loudspeaker. Consequently, the known loudspeaker occupies a relatively large space of the volume constituted by the housing, which leads to relatively high system resonances, and thus, to a relatively high lower limit of the frequency range associated with a given volume.

SUMMARY OF THE INVENTION

It is an object of the invention to provide a compact loudspeaker that can be subjected to a high load. According to the invention, this object is achieved with the loudspeaker which is characterized in that the air gap, which extends between the stationary actuator element and the translatable actuator element, is present outside the space enclosed and defined by the contours of the diaphragm and within an area between the first flexible connecting means and the second flexible connecting means.

Due to the characteristic feature described above, the loudspeaker according to the invention has only a limited axial dimension in spite of its three-dimensional diaphragm, so that it has a small build-in depth. Such a loudspeaker built in a housing therefore occupies a comparatively small volume, resulting in a low system resonance. The loudspeaker according to the invention is therefore eminently suitable for use in subwoofer systems in which compact, shallow housings are desired. The diaphragm used preferably has a conical central portion.

It is to be noted that European Patent Application No. EP 0806883, corresponding to U.S. Pat. No. 5,898,786, discloses a loudspeaker in which the electromagnetic drive of the diaphragm is situated within the space enclosed and defined by the contours of the diaphragm. In such a "wafer" loudspeaker, the available space within the diaphragm is, however, too small to build a sufficiently powerful magnetic system which complies with the high load requirements. Apart from the available space, the thermal load of the magnetic material of the magnetic system is also a limiting factor in this type of loudspeaker. Notably with modern magnetic material such as neodymium-iron-boron alloys, the maximum allowable temperatures are relatively low. For these reasons, a loudspeaker of this type is only suitable for loudspeaker systems having a relatively small power.

In a practical embodiment of the loudspeaker according to the invention, the stationary actuator element is at least largely, and preferably completely, present within a zone situated between the first flexible connecting means and the second flexible connecting means of the loudspeaker.

A preferred embodiment of the loudspeaker according to the invention is characterized in that the stationary actuator element comprises an annular permanent magnet, and the translatable actuator element comprises a magnet coil, also referred to as voice coil, the magnet coil being situated in a field surrounding the magnet, i.e., the magnetic field of the magnet.

In this embodiment, annular magnet coils having large coil diameters are possible. Such drive coils have large cooling faces and offer ample possibilities of ventilation so that they can be subjected to high loads. Consequently, the coil temperature remains relatively low during use, also in the case of high loads, and only a limited transfer of heat to the other parts, such as the permanent magnet of the actuator, takes place. This embodiment, therefore, has a favorable thermal household. It has been found that the temperature of the coil and the magnet remains within acceptable limits, also at higher powers. Modern magnetic materials, such as neodymium-iron-boron alloys, can, therefore, be used without any problem.

It is to be noted that International Patent Application No. WO-A 97/32451, corresponding to U.K. Patent Application No. GB 2,325,373A, discloses a loudspeaker unit which is provided with a damper fixed to a diaphragm. A coil former, with a coil extending in a magnetic gap surrounding a plate on a magnet, is fixed to the diaphragm, this gap extending outside the area bounded by the suspensions of the diaphragm. The magnet, which is situated at a maximum distance from the diaphragm, is fixed to a bottom part of the unit.

In a practical embodiment of the loudspeaker according to the invention, the first flexible connecting means has a flexible structure with an undulation or wrinkle, this first flexible connecting means being fixed to the chassis at one end and to the translatable body at the other end. In principle, the second flexible connecting means may be formed similarly.

To allow relatively large and accurately defined axial displacements of the translatable body with respect to the chassis, a preferred embodiment of the loudspeaker according to the invention is characterized in that the second flexible connecting means comprises a set of at least three leaf spring elements positioned around the translation axis, each leaf spring element comprising two leaf springs arranged in a slanting position with respect to a plane oriented transversely to the translation axis, the leaf springs of each leaf spring element being each provided with two peripheral parts each extending parallel to said plane, while one of the leaf springs is fixed to the chassis proximate to one of its peripheral parts and the other of its peripheral parts is fixed to the translatable body proximate to one of its peripheral parts, the leaf springs of each leaf spring element being interconnected proximate to their other peripheral parts. This embodiment of the second flexible connecting means allows a large axial displacement of the diaphragm, and is, therefore, suitable for applications where loudspeakers having a high sound-radiating power are desired.

The flexible connecting device used as the second flexible connecting means described hereinbefore, is essentially without friction and guarantees an accurate alignment of the translatable body and, hence, of the diaphragm with respect to the chassis. Embodiments of this connecting device are described and elucidated in European Patent Application No. EP-A 1036485, corresponding to U.S. Pat. No. 6,385,327, herein incorporated by reference. In this respect, it is only noted that the leaf springs of each leaf spring element are preferably connected or fixed to each other in a mutual undeformable manner at their adjacent peripheral parts. Furthermore, one leaf spring of each leaf spring element is preferably secured in or fixed to the translatable body in an undeformable manner and the other leaf spring is secured in or fixed to the chassis in an undeformable manner by means of one of its peripheral parts.

If desired, the loudspeaker according to the invention may be used as a band-pass loudspeaker for a limited frequency range. This may be achieved in an electrical manner. Notably in low-frequency loudspeakers, the electrical measures to be taken are, however, relatively expensive. A mechanical solution which forms part of the loudspeaker is less expensive and is, therefore, preferred. A suitable embodiment in this context is characterized in that the translatable actuator element is fixed via a coupling member to the translatable body with a defined bending stiffness and internal damping. The concrete values of the bending stiffness and the damping are determined as a function of the desired frequency range and the characteristics of the loudspeaker. A simulation program may be used for this purpose.

A practical embodiment of the band-pass loudspeaker according to the invention is characterized in that the translatable actuator element comprises a magnet coil arranged on a coil support, the coupling member connecting the coil support to a central portion of the translatable body.

The invention also relates to a loudspeaker unit comprising the electro-dynamic loudspeaker according to the invention and also comprising a housing accommodating the loudspeaker. The loudspeaker unit may form part of a compact subwoofer system, in which the loudspeaker or loudspeakers can be subjected to a high load. The loudspeaker according to the invention occupies only a limited space in the housing.

The loudspeaker and loudspeaker unit according to the invention may be successfully used in loudspeaker systems having very flat shapes, possibly combined with panel loudspeakers. Furthermore, applications in which only a limited mounting depth is available are suitable. Particular examples are automotive uses, such as, for example, mounting in a car door, in a luggage shelf or below a car seat. High powers of the order of, for example, about 150 watts are possible.

These and other aspects of the invention are apparent from and elucidated with reference to the embodiments described hereinafter.

DESCRIPTION OF THE PREFERRED EMBODIMENTS

Figure 1:
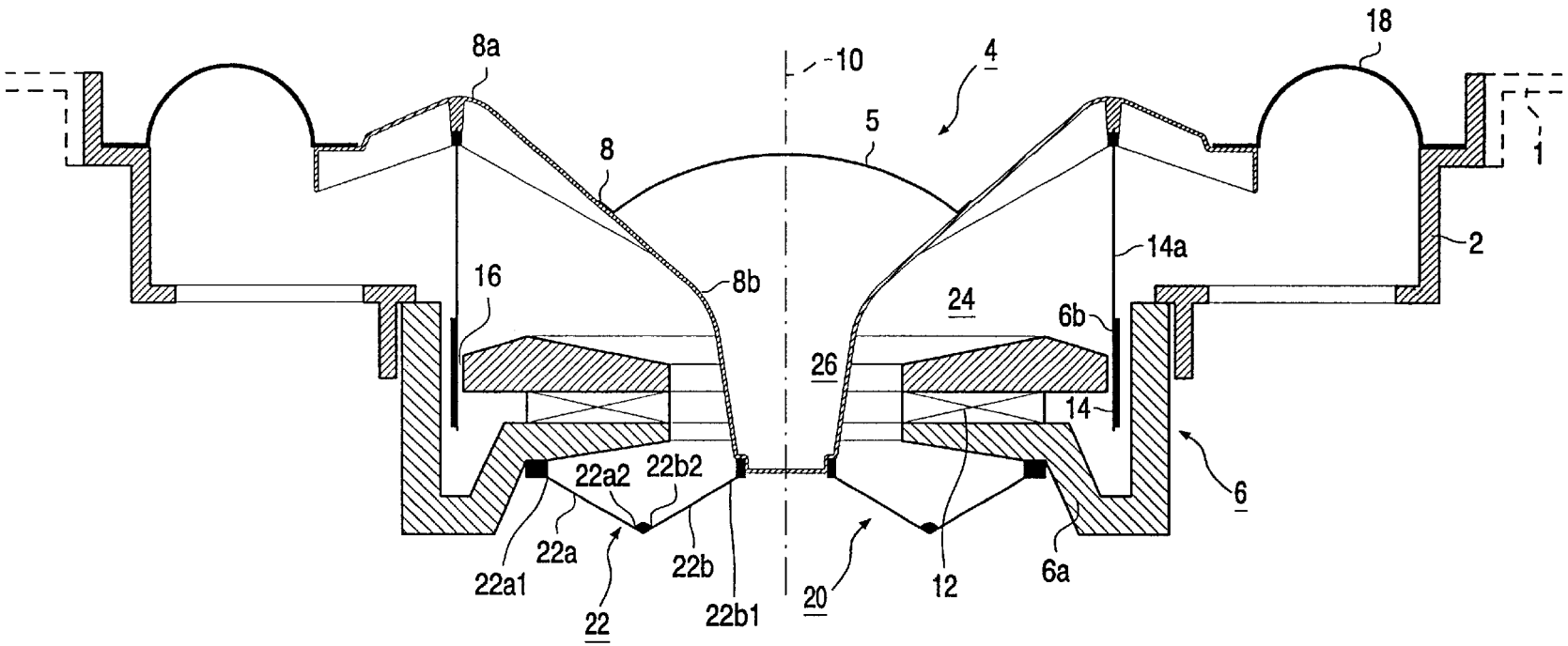
FIG. 1 shows a first embodiment of the loudspeaker according to the invention in a partly diagrammatic cross-section.
Figure 2:
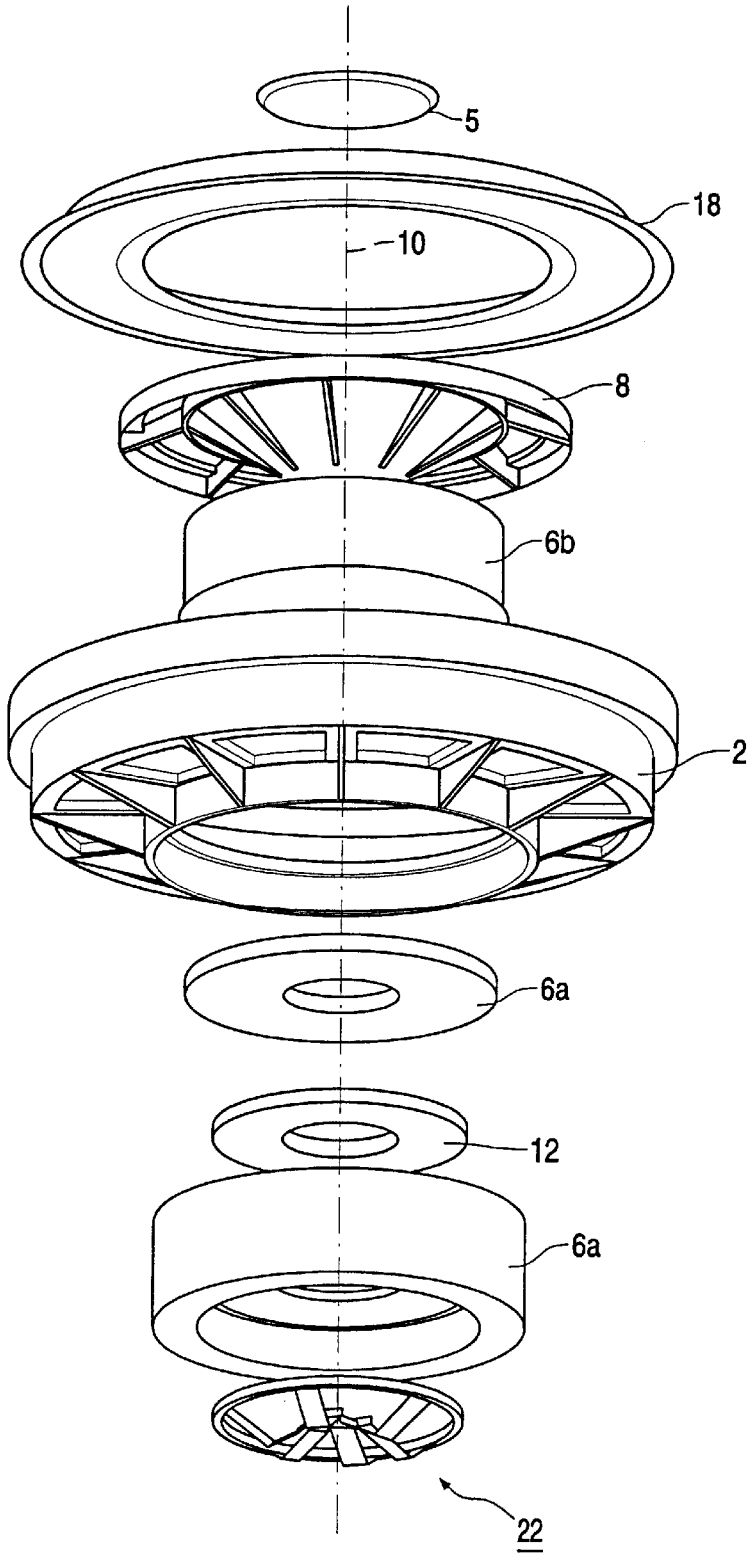
FIG. 2 is a perspective elevational view of the loudspeaker of FIG. 1 in an exploded view.
Figure 3:
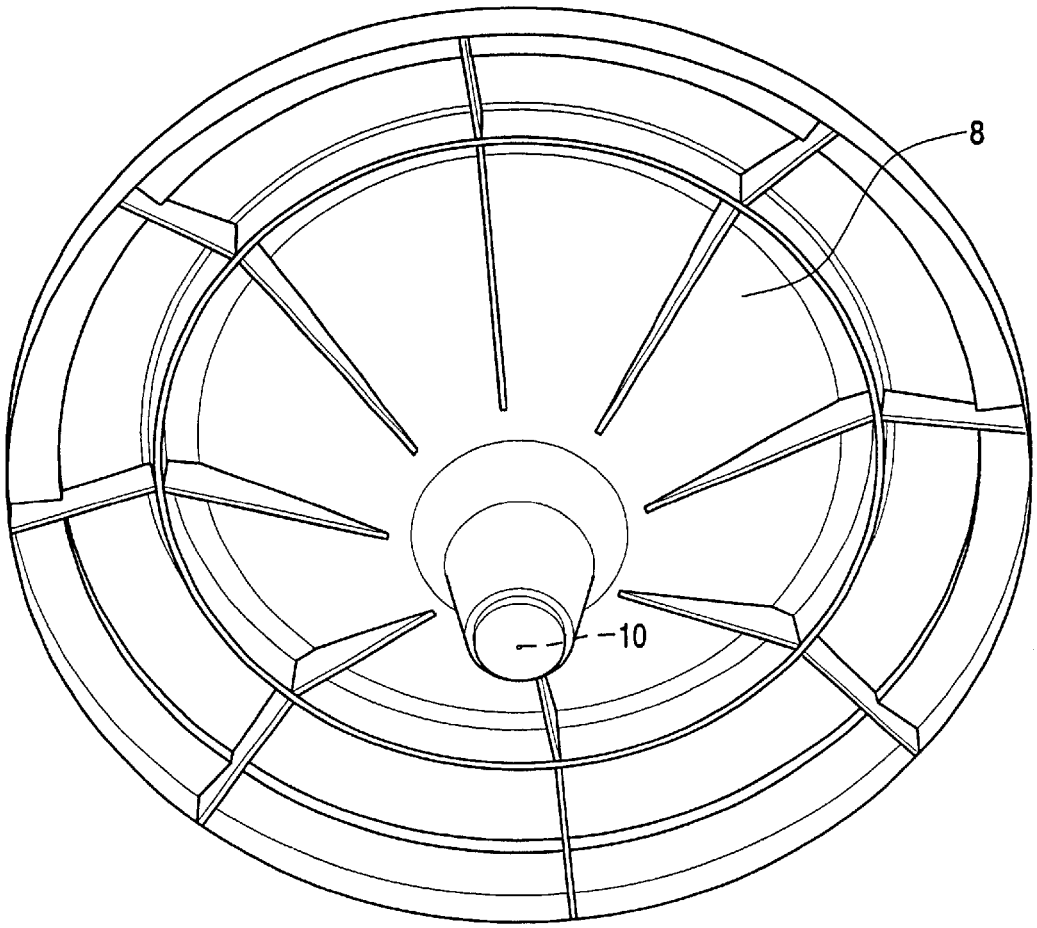
FIG. 3 is a perspective view of a component of the loudspeaker shown in FIGS. 1 and 2.

The electro-dynamic loudspeaker according to the invention, shown in FIGS. 1, 2 and 3, comprises a chassis 2, a translatable body 4 and an electromagnetic actuator 6, and is shielded by a dust cover 5. For forming a loudspeaker unit according to the invention, the loudspeaker may be accommodated in a housing. To this end, the chassis 2 of the loudspeaker may be fixed in an appropriate opening in a wall of the housing. In FIG. 1, the housing is shown, diagrammatically, by means of a wall section 1 in broken lines.

The translatable body 4 comprises a three-dimensional diaphragm 8, in this example a conical diaphragm, which is situated, or at least extends, in the chassis 2. The diaphragm 8 has a front part 8*a* and a back part 8*b*. The function of the electromagnetic actuator 6 is to displace the body 4 along a translation axis 10, being the central axis of the loudspeaker, extending from the front part 8*a* to the back part 8*b*, or vice versa. The actuator 6 essentially comprises two elements, namely, a stationary actuator element 6*a* which is fixed to the chassis 2 and a translatable actuator element 6*b* which is connected to the translatable body 4. One of the actuator elements, in this example the stationary element 6*a*, is provided with an annular permanent magnet 12 and the other actuator element, in this example the translatable body 6*b*, is provided with a magnet coil 14, in which, when energizing the magnet coil 14, both actuator elements 6*a*, 6*b* magnetically co-operate with each other over an air gap 16 for generating a driving force on the translatable body 4 parallel to the translation axis 10, and hence, on the diaphragm 8 forming a part thereof. The permanent magnet 12 forms a magnetic yoke with soft iron parts of the stationary actuator element 6*a*, this yoke defining the air gap 16 in this example. The magnet coil 14, being a cylindrical coil, also referred to as a voice coil, is situated on a coil support 14*a* which is formed as a cylinder in this example and fixed to the translatable body 4.

The loudspeaker according to the invention is provided with a flexible connection for the translatable body 4, and hence, for the diaphragm 8. This flexible connection comprises a first flexible connecting means 18 proximate to the front part 8*a* of the diaphragm 8 and a second flexible connecting means 20 proximate to the back part 8*b* of the diaphragm 8. The flexible connection is to ensure that the body 4, and, particularly, the diaphragm 8, can perform well-defined translation movements with respect to the chassis 2.

The first flexible connecting means 18 has a flexible structure formed from, for example, a corrugated rubber annular rim which is secured, for example, by glue on its outer circumference to the chassis 2 and on its inner circumference to the translatable body 4. In this example, the second flexible connecting means 20 comprises a set of leaf spring elements 22 positioned around the translation axis 10, in this example, six elements. Each leaf spring element 22 has two leaf springs 22*a,* 22*b* positioned in a slanting manner transversely to the translation axis 10. Each leaf spring 22*a,* 22*b* of each leaf spring element 22 is provided with two peripheral parts (22*a*1, 22*a*2; 22*b*1, 22*b*2) each extending parallel to said plane, in which the peripheral part 22*a*1 is fixed to the chassis 2 or, as in this example, is indirectly fixed thereto via the stationary actuator element 6*a,* the peripheral part 22*b*1 is fixed to the translatable body 4, and the peripheral parts 22*a*2 and 22*b*2 are fixed together. The fixation of a peripheral part to the chassis or to the translatable body, as well as the mutual fixation of the two peripheral parts is rigid. This is favorable for counteracting material fatigue, notably at the location of the fixations.

The loudspeaker according to the invention has a further characteristic feature in that the air gap 16 is present in an area 24 situated between and defined by the first flexible connecting means 18 and the second flexible connecting means 20 and is also situated outside the space 26 enclosed by the diaphragm 8. In this embodiment, the stationary actuator element 6*a* is largely situated in a zone between the first flexible connecting means 18 and the second flexible connecting means 20, this zone coinciding with the above-mentioned area 24. In this example, the annular magnet coil 14 is situated in a magnetic field surrounding the annular permanent magnet 12.

Figure 4:
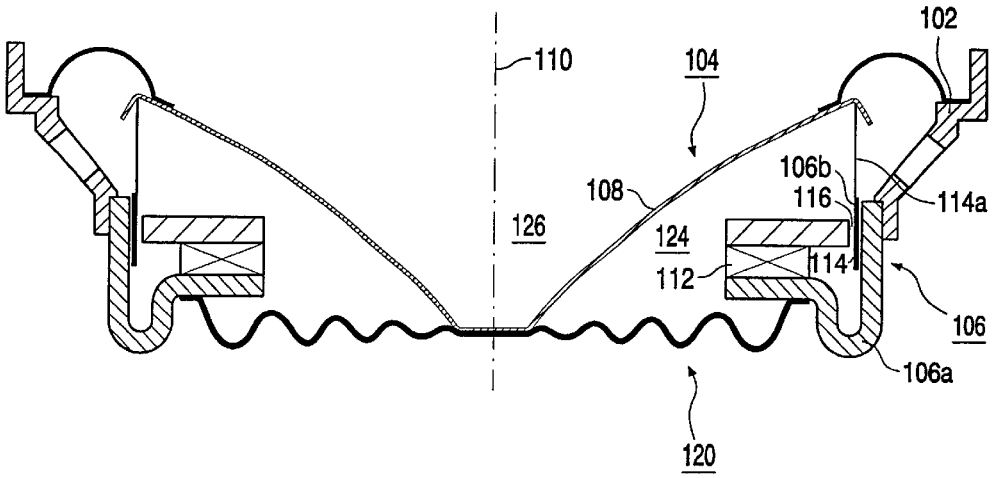
FIG. 4 shows a second embodiment of the loudspeaker according to the invention in a diagrammatic cross-section.

As far as the construction is concerned, the electromagnetic loudspeaker according to the invention shown in FIG. 4 corresponds to a large extent to the loudspeaker already described with reference to FIGS. 1, 2 and 3. An important difference is the flexible connection of the diaphragm, which is simpler in this example and allows the diaphragm to make a movement, i.e., an axial displacement, which is not so large. The loudspeaker has a chassis 102, a body 104 which is translatable along a translation axis 110 and an electromagnetic actuator 106. The body 104, which comprises a conical or otherwise three-dimensional diaphragm 108, is journaled with respect to the chassis 102 via a first flexible connecting means 118 and a second flexible connecting means 120, both in the form of a flexible structure of, for example, rubber, synthetic material and/or textile. In this example, the first flexible connecting means 118 is fixed to the translatable body 104 on the front side of the loudspeaker at one end and to the chassis 102 at the other end. The second flexible connecting means, which is situated on the back part of the loudspeaker, is fixed to the translatable body 104 at one end and to an element 106*a* fixed to the chassis 102 at the other end.

In principle, the actuator 106 comprises two elements, namely, a stationary actuator element, being the above-mentioned element 106*a,* and an actuator element 106*b* which is translatable with respect to said element and is fixed to the body 104. The stationary actuator element has a magnetic yoke with a permanent magnet 112, and the translatable actuator element 106*b* has a voice coil 114 arranged on a coil support 114*a,* this voice coil 114 and coil support 114*a,* upon energization, magnetically co-operating over an air gap 116 with the magnet 112. In order to realize a very flat loudspeaker which can be subjected to a high load, such a construction has been invented that the air gap 116 is situated both outside the space 126 defined by the contours of the diaphragm 108 and within an area 124 situated between the first connecting means 118 and the second connecting means 120.

Figure 5:
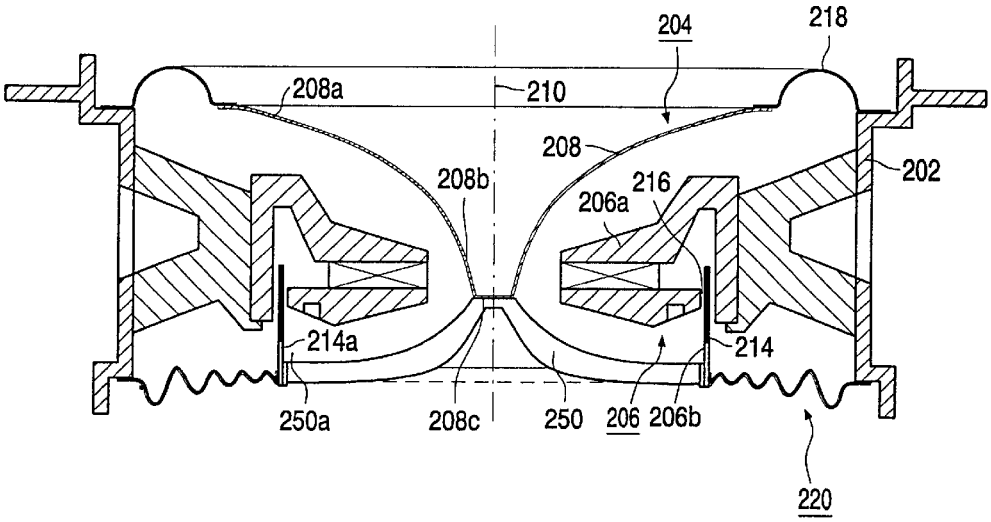
FIG. 5 shows a third embodiment of the loudspeaker according to the invention in a diagrammatic cross-section.

As regards the location of the air gap, the electromagnetic loudspeaker according to the invention shown in FIG. 5 corresponds to the embodiments already described, but has a provision which makes it suitable as a band-pass loudspeaker.

The loudspeaker has a chassis 202, a translatable body 204 with a diaphragm 208 and an electro-dynamic actuator 206 which comprises a stationary actuator element 206*a* fixed to the chassis 202 and a translatable actuator element 206*b,* which elements can magnetically co-operate with each other over an air gap 216. The body 204 is movably journaled with respect to the chassis 202 along a translation axis 210. A first flexible connecting means 218 and a second flexible connecting means 220, both formed, for example, as described with reference to the example of FIG. 4, are used for this purpose. The first flexible connecting means 218 connects the body 204 to the chassis 202 proximate to the front part 208*a* of the diaphragm 208. Proximate to a back part 208*b* of the diaphragm 208, the loudspeaker comprises a coupling member 250 secured to the body 204, this coupling member having a predetermined bending stiffness and a predetermined internal damping both defined by the desired pass band. In this example, the coupling member 250 is made of a synthetic material and has a flat conical shape. The coupling member 250, which is fixed to the body 204 proximate to a central part 208*c* of the diaphragm 208, in this example, supports the translatable actuator element 206*b* on a periphery 250*a,* particularly, a coil support 214*a* thereof, provided with a magnet coil 214. The second flexible connecting means 220 connects the coupling member 250 to the chassis 202.

It is to be noted that the invention is not limited to the embodiments shown. For example, the embodiments of the flexible connecting means for the translatable body may also be constructed in different suitable manners. Moreover, the loudspeaker unit may not only comprise one or more loudspeakers according to the invention but also one or more bass reflex gates and/or one or more passive radiators. Furthermore, the loudspeakers are not limited to the power of approximately 150 watts mentioned in this document.

What is claimed is:

1. An electro-dynamic loudspeaker comprising a chassis;

a translatable body with a three-dimensional diaphragm extending within the chassis, said three-dimensional diaphragm comprising a front part and a back part;

an electromagnetic actuator for displacing said translatable body with respect to the chassis along a translation axis extending from said front part to said back part of the diaphragm, said electromagnetic actuator comprising a stationary actuator element fixed to the chassis and a translatable actuator element connected to the translatable body proximate to the back part of the diaphragm, said stationary and translatable actuator elements magnetically co-operating with each other over an air gap;

a first flexible connecting means proximate to the front part of the diaphragm for connecting the translatable body to the chassis, said first flexible connecting means movably journaling the translatable body with respect to the chassis; and a second flexible connecting means proximate to the back part of the diaphragm for connecting the translatable body to the chassis, said second flexible connecting means movably journaling the translatable body with respect to the chassis, wherein the air gap, extending between the stationary actuator element and the translatable actuator element, is located outside a space enclosed and defined by contours of the diaphragm, and within an area between the first flexible connecting means and the second flexible connecting means.

2. The electro-dynamic loudspeaker as claimed in claim 1, characterized in that the stationary actuator element is at least largely present within a zone situated between the first flexible connecting means and the second flexible connecting means.

3. The electro-dynamic loudspeaker as claimed in claim 1, characterized in that the stationary actuator element comprises an annular permanent magnet, and the translatable actuator element comprises a magnet coil, the magnet coil being situated in a field surrounding the magnet.

4. The electro-dynamic loudspeaker as claimed in claim 1, characterized in that the first flexible connecting means has a flexible structure with an undulation or wrinkle, said first flexible connecting means being fixed to the chassis at one end and to the translatable body at the other end.

5. The electro-dynamic loudspeaker as claimed in claim 1, characterized in that the second flexible connecting means comprises a set of at least three leaf spring elements positioned around the translation axis, each leaf spring element comprising two leaf springs arranged in a slanting position with respect to a plane oriented transversely to the translation axis, the leaf springs of each leaf spring element being each provided with two peripheral parts each extending parallel to said plane, of the leaf springs being fixed to the chassis proximate to one of said two peripheral parts and the other of the leaf springs being fixed to the translatable body proximate to one of its peripheral parts, the leaf springs of each leaf spring element being interconnected proximate to their respective other peripheral parts.

6. The electro-dynamic loudspeaker as claimed in claim 1, characterized in that the electro-dynamic loudspeaker further comprises a coupling member for fixing the translatable actuator element to the translatable body, said coupling member having a defined bending stiffness and internal damping.

7. The electro-dynamic loudspeaker as claimed in claim 6, characterized in that the translatable actuator element comprises a magnet coil arranged on a coil support, the coupling member connecting the coil support to a central portion of the translatable body.

8. A loudspeaker unit comprising the electro-dynamic loudspeaker as claimed in claim 1, said loudspeaker unit further having a housing for accommodating the electro-dynamic loudspeaker.

* * * * *